US005203271A

United States Patent [19]

Chapman

[11] Patent Number: 5,203,271

[45] Date of Patent: Apr. 20, 1993

[54] SHALLOW DRAFT BARGE

[76] Inventor: Malcolm G. Chapman, P.O. Box 834, Middletown, Conn. 06457

[21] Appl. No.: 704,089

[22] Filed: May 22, 1991

[51] Int. Cl.[5] ..... B63B 1/12

[52] U.S. Cl. ..... 114/26; 114/61; 441/35

[58] Field of Search ..... 114/26, 61, 123, 355, 114/356, 357, 358, 343; 441/35, 44

[56] References Cited

U.S. PATENT DOCUMENTS

| | | | |
|---|---|---|---|
| 3,745,954 | 7/1973 | Louet | 114/26 |
| 4,406,239 | 9/1983 | Enzmann | 114/61 |
| 4,562,786 | 1/1986 | Pruonto | 114/61 |
| 4,635,580 | 1/1987 | Nishida | 114/343 |
| 4,706,810 | 11/1987 | Petrilli | 114/343 |
| 4,715,306 | 12/1987 | Horais | 114/61 |
| 4,957,056 | 9/1990 | Martin | 114/343 |
| 4,993,350 | 2/1991 | Pepper | 114/61 |
| 5,076,191 | 12/1991 | Madore | 114/343 |

*Primary Examiner*—Joseph F. Peters, Jr.
*Assistant Examiner*—Stephen P. Arica
*Attorney, Agent, or Firm*—Robert S. Smith

[57] ABSTRACT

A barge apparatus which includes first and second elongated pontoon members each including a buoyant foamed plastic material and decking bridging the pontoon members with the pontoon members disposed in spaced relationship. Each of the pontoon members including first and second elongated longitudinally extending members that extend substantially the entire length of the pontoon member proximate to the upper surface thereof and each of the pontoon members including first and second lower corner angles disposed in nested relatioship to the lower extremities of the buoyant foam plastic material. The apparatus also includes either a plurality of straps disposed at axially spaced intervals along each of the elongated longitudinally extending members with each of the straps extending around the buoyant foam plastic material and the first and second lower corner angles or other apparatus that joins these members. The invention also includes the method of manufacturing which includes supporting the entire weight of the members and the material at the axial extremities of the elongated longitudinally extending members and fixing the structural members together.

4 Claims, 3 Drawing Sheets

SHALLOW DRAFT BARGE

BACKGROUND OF THE INVENTION

The invention relates to water craft and particularly to barges having very low draft.

The prior art includes many types of barges. Often they have been used for carrying cargo and have been manufactured with heavy steel plates. This results in a very heavy structure that is difficult to move and has a substantial draft.

It is an object of the invention to provide a barge having a much lighter structure than barges that have been generally known.

It is another object of the invention to provide apparatus which is inexpensive to manufacture as well as requires a minimum of labor to install.

Still another object of the invention is to provide a structure that may be moved in and out of the water more easily.

It is yet another object of the present invention to provide apparatus that has a much more shallow draft than barges that have been used generally.

SUMMARY OF THE INVENTION

It has now been found that these and other objects of the invention may be attained in a barge apparatus which includes first and second elongated pontoon members each including a buoyant foamed plastic material and decking bridging the pontoon members with the pontoon members disposed in spaced relationship. Each of the pontoon members including first and second elongated longitudinally extending members that extend substantially the entire length of the pontoon member proximate to the upper surface thereof and each of the pontoon members including first and second lower corner angles disposed in nested relationship to the lower extremities of the buoyant foam plastic material. The apparatus also includes either a plurality of straps disposed at axially spaced intervals along each of the elongated longitudinally extending members with each of the straps extending around the buoyant foam plastic material and the first and second lower corner angles or other means that joins these members.

In some forms of the invention the first and second elongated longitudinally extending members are angle members and in other forms of the invention they are rectangular tubing. These members may be steel members. A support member may extend intermediate the pontoon members in spaced relation to the decking. A helm may be carried on the decking and the helm may be constructed to permit folding downward.

The invention also includes the method of manufacturing which includes supporting the entire weight of the members and the material at the axial extremities of the elongated longitudinally extending members and fixing the structural members together.

BRIEF DESCRIPTION OF THE DRAWING

The invention will be better understood by reference to the accompanying drawing in which.

DESCRIPTION OF THE PREFERRED EMBODIMENT

Figure 1:
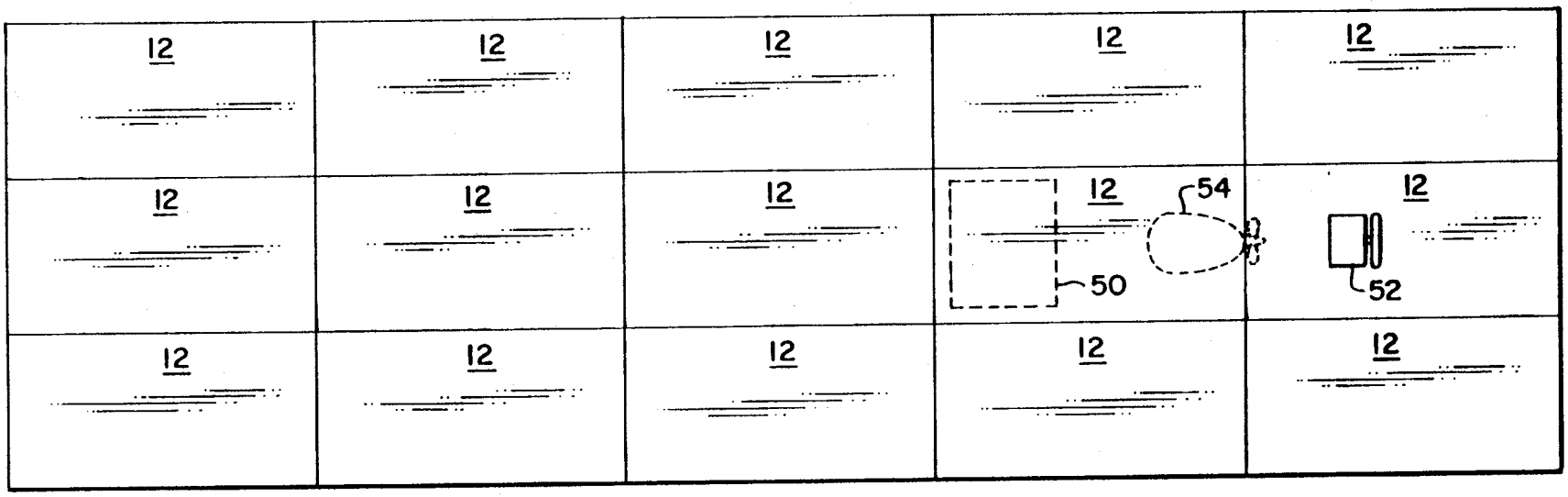
FIG. 1 is a top plan view of a preferred embodiment of the invention.

Referring now to FIGS. 1, 2, 3, and 4 there is shown a first preferred embodiment of the invention.

The barge 10 in accordance with one form of the invention has generally horizontal decking formed from a plurality of 4'×8' sheets of plywood 12. The decking is supported on four longitudinally extending generally parallel channels 14. Ordinarily, adjacent channels 14 are mutually spaced apart substantially the same distance and extend substantially the entire length of the barge 10. Disposed immediately below the outermost pairs of channels 14 are respective pontoons formed of styrofoam members 17 which are of substantially the same size. Ordinarily the styrofoam members 17 extend substantially the entire length of the barge 10.

Each styrofoam member 17 is retained and protected from damage by lower corner angles 20 at each of the bottom corners thereof. Each lower corner angle 20 is joined to one of the channels 14 by a plurality of straps 22. Also joined to each channel 14 is a longitudinal angle 16 which extends substantially the entire length of the barge 10. Each longitudinal angle 16 has the axial extremities thereof obliquely angled with respect to the major axial portion thereof. More particularly, the major axial portion thereof is rectilinear. A plurality of vertical angles 18 disposed at spaced intervals also connect each of the channels 14 to one of the longitudinal angles 16. It will be understood that each of the straps 22 is also connected to one of the longitudinal angles.

Figure 8:
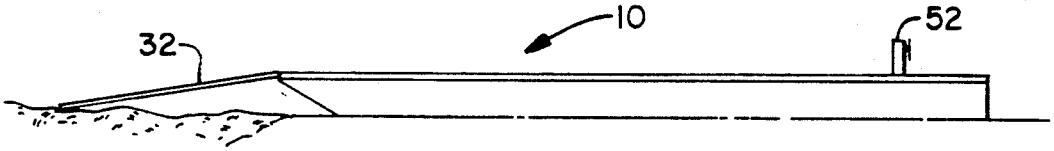
FIG. 8 is side elevational view of a barge in accordance with the invention showing the manner of use of ramps for unloading cargo and troops.

A support 30 is generally planar and fixed to the lower (as viewed) axial extremities of each of a plurality of vertical angles 18. The support 30 is provided for carrying a plurality of ramp members 32. As best shown in FIG. 8 the ramp members 32 provide for ease of unloading of cargo and troops from the barge 10.

Figure 2:
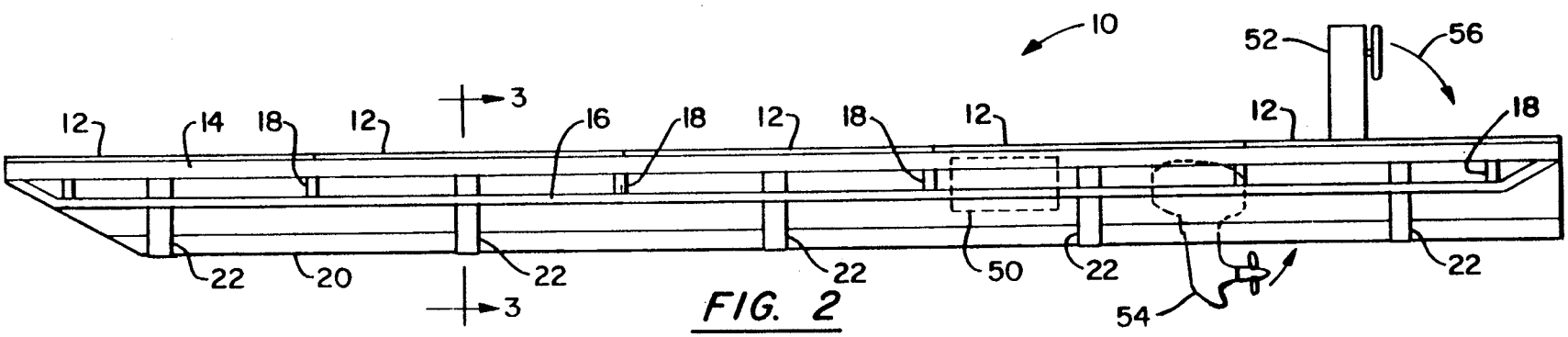
FIG. 2 is a side elevational view of the apparatus show in FIG. 1.
Figure 3:
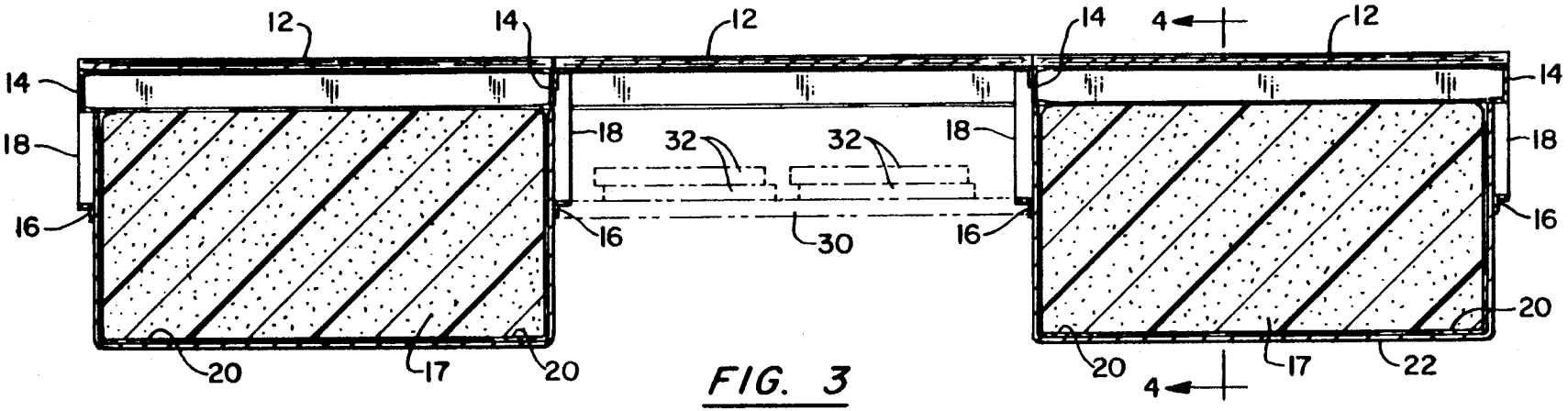
FIG. 3 is a sectional view taken along the line 3—3 of FIG. 1.

The barge 10 includes a helm 52 that is constructed to be folded down as indicated by the arrow 56. The folding of the helm 52 is important for shipping. It will be understood that the combination of light weight and compactness facilitates shipment by air or ground. A single outboard motor 54 may be mounted intermediate the pontoons as shown in FIGS. 1 and 2.

Figure 5:
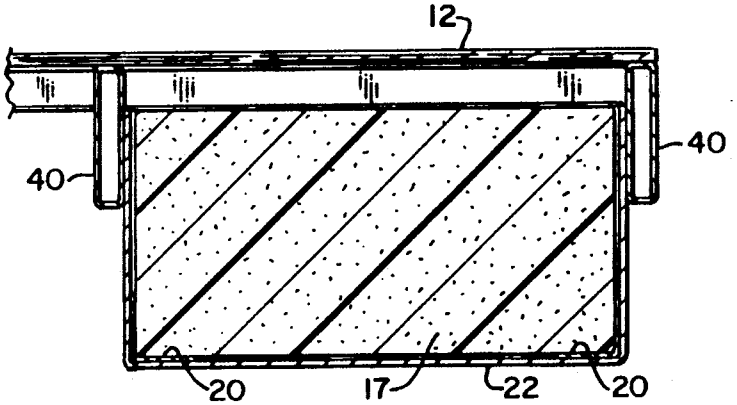
FIG. 5 is a fragmentary sectional view of an alternate structure to that shown in FIG. 3.
Figure 4:
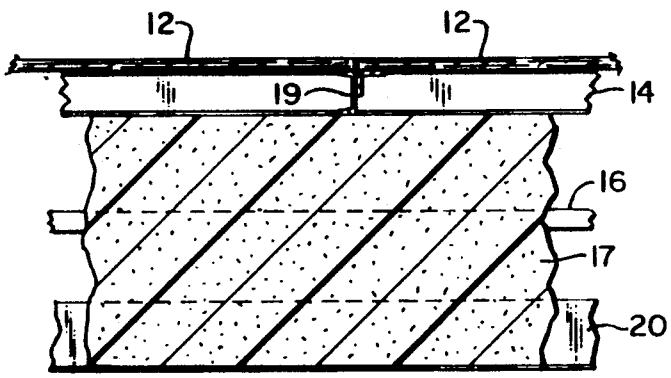
FIG. 4 is a fragmentary sectional view taken along the line 4—4 of FIG. 3.

An alternate construction is shown in FIG. 5 which includes styrofoam members 17 as in other embodiments. Instead of the plurality of channels 14 a rectangular tubing member is used. This embodiment has the advantage of using less parts than other embodiments. It will be understood that flat stock is ordinarily not desirable because the resulting structure is not rigid enough.

Figure 6:
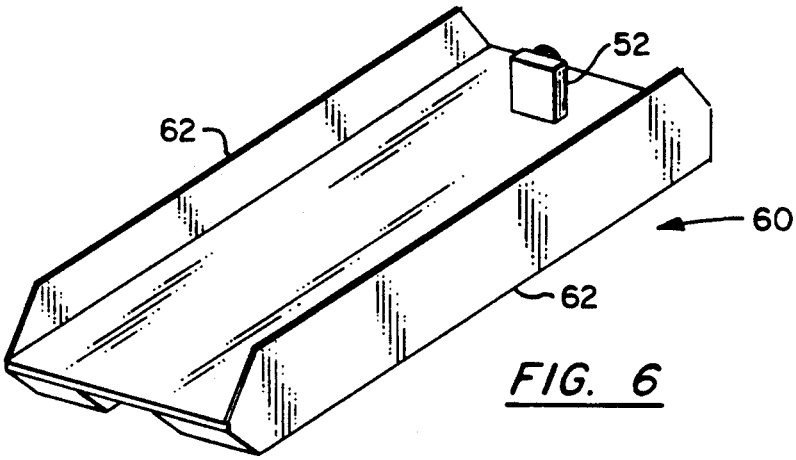
FIG. 6 is a perspective view of a military version of the invention that includes steel plates that extend vertically on each side to protect troops that are being carried on the barge.

Referring now to FIG. 6 there is shown an alternative embodiment 60. The alternative embodiment 60 includes a vertical steel plate 62 on each side of the alternative embodiment 60. Each vertical steel plate 62 is provided to protect troops to be carried on the alternative embodiment 60.

Figure 7:
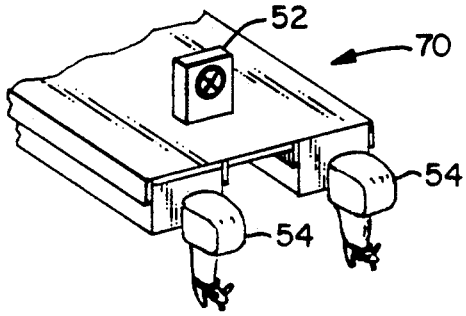
FIG. 7 is a fragmentary perspective view of an embodiment that carries two separate outboard motors on the stern.

Referring to FIG. 7 there is shown an alternative embodiment 70 that includes provision for mounting an outboard motor on the stern of each pontoon. This has the advantage of keeping the tunnel open intermediate the pontoons. For some application this arrangement is advantageous.

It will be understood that the dual pontoon construction is advantageous for many applications. For example, if the barge 10 is used for bridge repairs on a bridge spanning a river. The positioning of the barge 10 under the bridge will have a minimum effect on the flow of water in the river because of the shallow draft of the barge 10 and the open tunnel area intermediate the pontoons thereof.

Various forms of the invention may be used as part of a shallow draft motor barge or a motorized push barge.

Advantageously, the structure of the barge 10 is prestressed during construction. In one approach the axial extremities of the channel 14 are supported by columns or jacks (not shown) before the rest of the structure is fully welded together. Thus when the support under the axial extremities are withdrawn the longitudinal angles 16 are placed in compression and the final structure is more rigid.

Alternatively, the mid-point of the channel 14 is supported before the rest of the structure is welded together. Thus, when the support is removed and placed in the water the final structure is more rigid and the longitudinal angle 16 is in tension.

Figure 9:
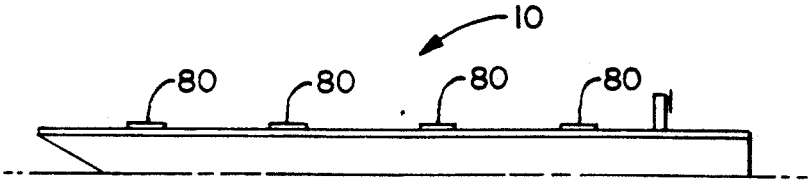
FIG. 9 is a side elevational view of a barge on which is carried laterally extending ramp pieces for applications where the barge is used as a Bailey Bridge.

The embodiment of the barge 10 shown in FIG. 9 is provided with ramp members 80 for vehicles that are passing over a pontoon or Bailey Bridge formed by a plurality of barges 10. Typically, each of the barges will be secured by spuds driven into the river bed to retain the barge 10.

The nature of the construction of the barge in accordance with the invention permits relative ease in unloading as well as very quiet unloading. In contrast to barges manufactured from sheet steel the cost is much less and the barge is much more easily moved. More specifically, the ease of movement is apparent whether the user wishes to move the barge 10 feet or 10,000 miles.

The tremendous reduction in weight inherent in avoiding the heavy sheet metal barges with the structure in accordance with the invention tremendously reduces the weight of the barge and thus tremendously reduces the draft of the barge.

Although the invention has been described in terms of styrofoam members 17 it will be understood that other buoyant foamed plastic material may be used. Ordinarily the structural members will be manufactured of steel because it is easier to weld than other metals. Those skilled in the art will recognize that other materials may be utilized without departing from the spirit of the invention.

The invention has been described with reference to its illustrated preferred embodiment. Persons skilled in the art of such devices may upon exposure to the teachings herein, conceive other variations. Such variations are deemed to be encompassed by the disclosure, the invention being delimited only by the following claims.

Having thus described my invention I claim:

1. A barge apparatus which comprises:

first and second elongated pontoons each including a unitary mass of buoyant foamed plastic material, each of said pontoons having an upper surface;

decking bridging said pontoons with said pontoons disposed in spaced relationship;

each of said pontoons including first and second elongated longitudinally extending members that extend substantially the entire length of the pontoon member proximate to the upper surface thereof;

each of said pontoons including first and second lower corner angles disposed in nested relationship to the lower extremities of said buoyant foam plastic material;

a plurality of straps disposed at axially spaced intervals along each of said elongated longitudinally extending members, each of said straps extending around said buoyant foam plastic material and said first and second lower corner angles, said first and second elongated longitudinally extending members being angle members, said first and second elongated longitudinally extending members being rectangular tubing, said apparatus including a support member extending intermediate said pontoons in spaced relation to said decking, and a helm carried on said decking, said helm being constructed to permit folding downwardly, each of said members being a steel member.

2. A barge apparatus which comprises:

first and second elongated pontoons each including a buoyant foamed plastic material, each of said pontoons having an upper surface; decking bridging said pontoons with said pontoons disposed in spaced relationship;

each of said pontoons including first and second elongated longitudinally extending members that extend substantially the entire length of the pontoon member proximate to the upper surface thereof;

each of said pontoons including first and second lower corner angles disposed in nested relationship to the lower extremities of said buoyant foam plastic material; and means disposed at axially spaced intervals along each of said elongated longitudinally extending members, each of said means extending around said buoyant foam plastic material and engaging said first and second lower corner angles, said first and second elongated longitudinally extending members being angle members, said first and second elongated longitudinally extending members being rectangular tubing, a support member extending intermediate said pontoons in spaced relation to said decking, said apparatus also including a support member extending intermediate said pontoons in spaced relation to said decking and a helm carried on said decking, said helm being constructed to permit folding downwardly, each of said members being a steel member.

3. A barge apparatus which comprises:

first and second elongated pontoons comprising a unitary mass of buoyant foamed plastic material, each pontoon member having an upper surface;

decking bridging said pontoons with said pontoons disposed in spaced relationship;

each of said pontoons including first and second elongated longitudinally extending members that extend substantially the entire length of the pontoon member proximate to the upper surface thereof, said elongated longitudinally extending members being prestressed to minimize bending thereof under load;

each of said pontoons including first and second lower corner angles disposed in nested relationship to the lower extremities of said buoyant foam plastic material; and a plurality of straps disposed at axially spaced intervals along each of said elongated longitudinally extending members, each of said straps extending around said buoyant foam plastic material and said first and second lower corner angles, said first and second elongated longitudinally extending members being angle members, said first and second elongated longitudinally extending members being rectangular tubing each of said members being a steel member, said apparatus further including a support member extending intermediate said pontoons in spaced relation to said decking and a helm carried on said decking, said helm being constructed to permit folding downwardly.

4. A barge apparatus which comprises:

first and second elongated pontoons comprising a unitary mass of buoyant foamed plastic material, each pontoon member having an upper surface;

decking bridging said pontoons with said pontoons disposed in spaced relationship; each of said pontoons including first and second elongated longitudinally extending members that extend substantially the entire length of the pontoon member proximate to the upper surface thereof;

each of said pontoons including first and second lower corner angles disposed in nested relationship to the lower extremities of said buoyant foam plastic material; and means disposed at axially spaced intervals along each of said elongated longitudinally extending members, each of said means extending around said buoyant foam plastic material and engaging said first and second lower corner angles, said first and second elongated longitudinally extending members being angle members, said first and second elongated longitudinally extending members are rectangular tubing, each of said members being a steel member, said apparatus further including a support member extending intermediate said pontoons in spaced relation to said decking and a helm carried on said decking, said helm being constructed to permit folding downwardly.

* * * * *